US005621986A

United States Patent [19]

Medina et al.

[11] Patent Number: 5,621,986

[45] Date of Patent: Apr. 22, 1997

[54] CALLOUS REMOVING SHOE

[76] Inventors: Emir A. Medina, 116-20 91st Ave., Queens, N.Y. 11418; Clara D'Aiuto, 495 Main Ave., Wood-Ridge, N.J. 07075

[21] Appl. No.: 537,445

[22] Filed: Oct. 2, 1995

[51] Int. Cl.[6] ..... A43B 5/08; A43B 3/12

[52] U.S. Cl. ..... 36/136; 36/8.1; 36/11.5; 36/95

[58] Field of Search ..... 36/1, 8.1, 11:5, 36/95, 132, 136

[56] References Cited

U.S. PATENT DOCUMENTS

| | | | |
|---|---|---|---|
| 1,746,478 | 2/1930 | Howland | 36/8.1 |
| 1,961,910 | 6/1934 | Pike | 36/8.1 |
| 2,611,977 | 9/1952 | Yamada | 36/11.5 |
| 3,987,559 | 10/1976 | Roberts | 36/95 |
| 4,823,426 | 4/1989 | Bragga | 36/136 |
| 4,837,960 | 6/1989 | Skaja | 36/136 |
| 4,976,049 | 12/1990 | Myers | 36/8.1 |
| 5,371,958 | 12/1994 | Brosseau | 36/11.5 |

*Primary Examiner*—M. D. Patterson

[57] ABSTRACT

A slip-on shoe is shaped so that it can be worn on either foot of a user, and it includes a pumice stone which is attached to a top surface of the shoe. A wearer can wear the shoe on one foot and then rub the other bare foot over the pumice stone to remove callouses.

3 Claims, 3 Drawing Sheets

CALLOUS REMOVING SHOE

BACKGROUND OF THE INVENTION

1. Field of the Invention

The present invention relates to therapeutic shoes and more particularly pertains to a therapeutic shoe for assisting in the removal of callouses from a wearer's foot.

2. Description of the Prior Art

Shoes designed for the purpose of both protecting a wearer's foot and providing medical or therapeutic treatment thereto are known in the prior art. For example, U.S. Pat. No. Design 346,062, which issued to Owens on Apr. 19, 1994, discloses a slipper having a pocket into which a therapeutic pad may be inserted. As shown in FIG. 3 of this patent, the pad may be positioned against the heel of a wearer, and the slipper may then be fastened shut to retain the pad in position. As such, the slipper functions to both protect the wearer's foot while operating to retain a medical treatment pad in a desired location.

Another typical medical treatment type shoe is disclosed in U.S. Pat. No. 5,322,056 which issued to Menghi et al. on Jun. 21, 1994. This patent discloses a self-massaging insole for slippers and is utilized in combination with such slippers to achieve a combined foot protection and medical treatment function.

U.S. Pat. No. 4,122,599, which issued to Krippelz on Sep. 12, 1978, discloses a slip-on type shoe which is constructed of bubble wrap so as to be formed of a plurality of sealed air cells of sufficient strength to support the weight of a wearer while providing a cushioning and ventilating effect to the wearer's feet.

U.S. Pat. No. 4,571,851, which issued to Yamada on Feb. 25, 1986, is relevant to the construction of the present invention inasmuch as it discloses a slipper-like shoe which is symmetrically shaped along its axial length so as to be utilizable with either foot of a wearer. While eliminating the need for a left shoe and a right shoe, this patent does not disclose any means of providing a medical treatment in combination with a conventional foot covering function.

The callous removing shoe according to the present invention substantially departs from the conventional concepts and designs of the prior art, and in so doing provides a shoe construction which may provide a medical function while eliminating the need for a specially designed left foot and right foot construction. As opposed to providing medical treatment in the form of cushioning and massaging, the present invention is designed to remove callouses from the foot of a wearer with this concept and function not being disclosed in the prior art.

SUMMARY OF THE INVENTION

In view of the foregoing disadvantages inherent in the known types of therapeutic shoes now present in the prior art, the present invention provides an improved construction wherein the same can be utilized for effecting a removal of unwanted callouses from the feet of a wearer.

To attain this, the present invention generally comprises a slip-on shoe which can be worn on either foot of a user and which includes a top mounted pumice stone that extends substantially above the surface of the shoe. The pumice stone is accessible to a wearer's bare foot, whereby the wearer may rub foot callouses against the stone to effect their removal without the necessity of performing a manual operation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved therapeutic shoe which has all of the advantages of the therapeutic shoes mentioned heretofore and many novel features that result in a callous removing shoe which is not anticipated, rendered obvious, suggested, or even implied by any of the prior art therapeutic shoes, either alone or in any combination thereof.

It is another object of the present invention to provide a new callous removing shoe which may be easily and efficiently manufactured and marketed.

It is a further object of the present invention to provide a new callous removing shoe which is of a durable and reliable construction.

An even further object of the present invention is to provide a new callous removing shoe which is susceptible of a low cost of manufacture with regard to both materials and labor, and which accordingly is then susceptible of low prices of sale to the consuming public, thereby making such callous removing shoes economically available to the buying public.

Still yet another object of the present invention is to provide a new callous removing shoe which provides in the apparatuses and methods of the prior art some of the advantages thereof, while simultaneously overcoming some of the disadvantages normally associated therewith.

Still another object of the present invention is to provide a new and improved therapeutic shoe which is particularly designed to facilitate the removal of callouses from the feet of a wearer.

Yet another object of the present invention is to provide a new and improved therapeutic shoe which of a symmetric design whereby it may be worn on either foot of a user, thereby allowing the user the option of buying one or two shoes as desired.

Even still another object of the present invention is to provide a new and improved therapeutic shoe which may be worn as a slipper while providing the option of removing callouses from the feet of a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
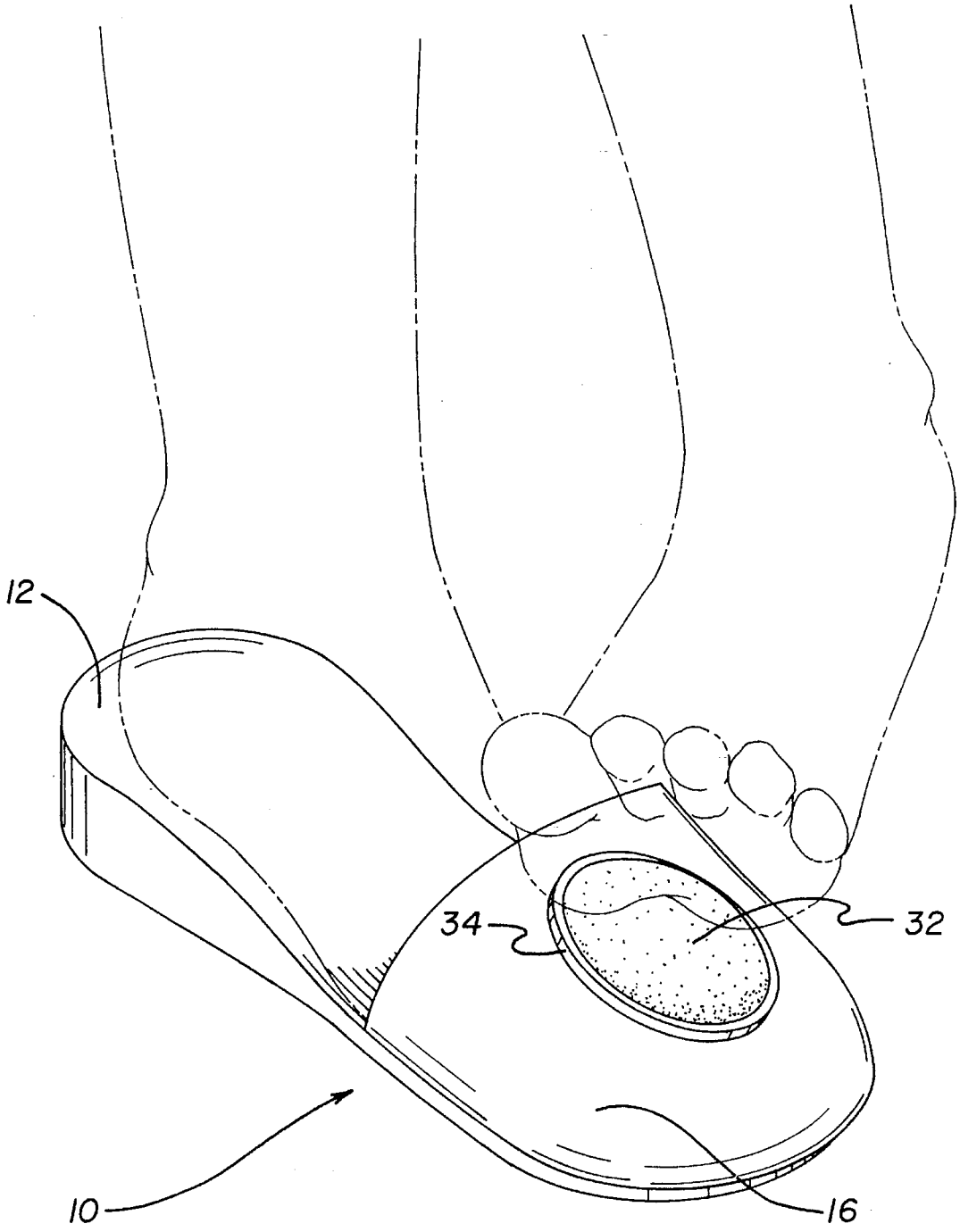
FIG. 1 is a perspective view of the callous removing shoe forming the present invention.
Figure 2:
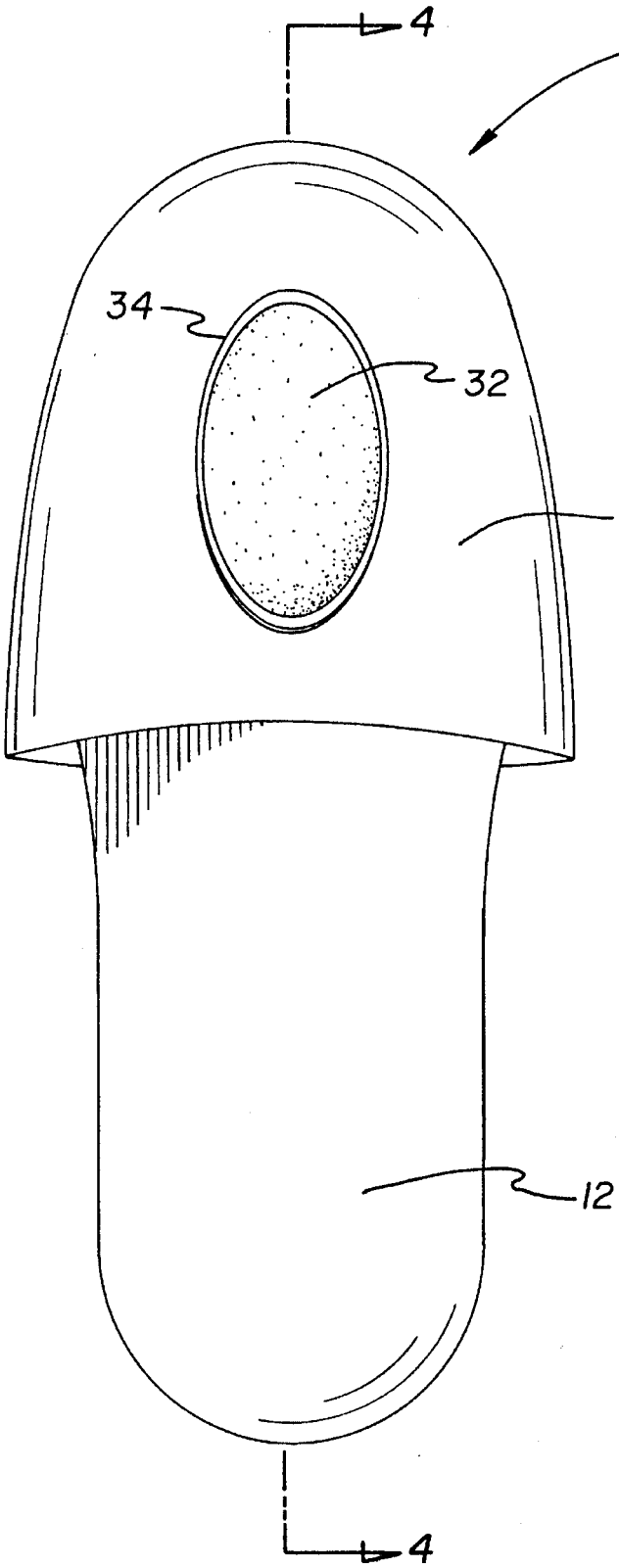
FIG. 2 is a top plan view thereof.

With reference now to the drawings and in particular to FIGS. 1–4 thereof, a new and improved callous removing shoe construction embodying the principles and concepts of the present invention and generally designated by the reference numeral 10 will be described.

Figure 4:
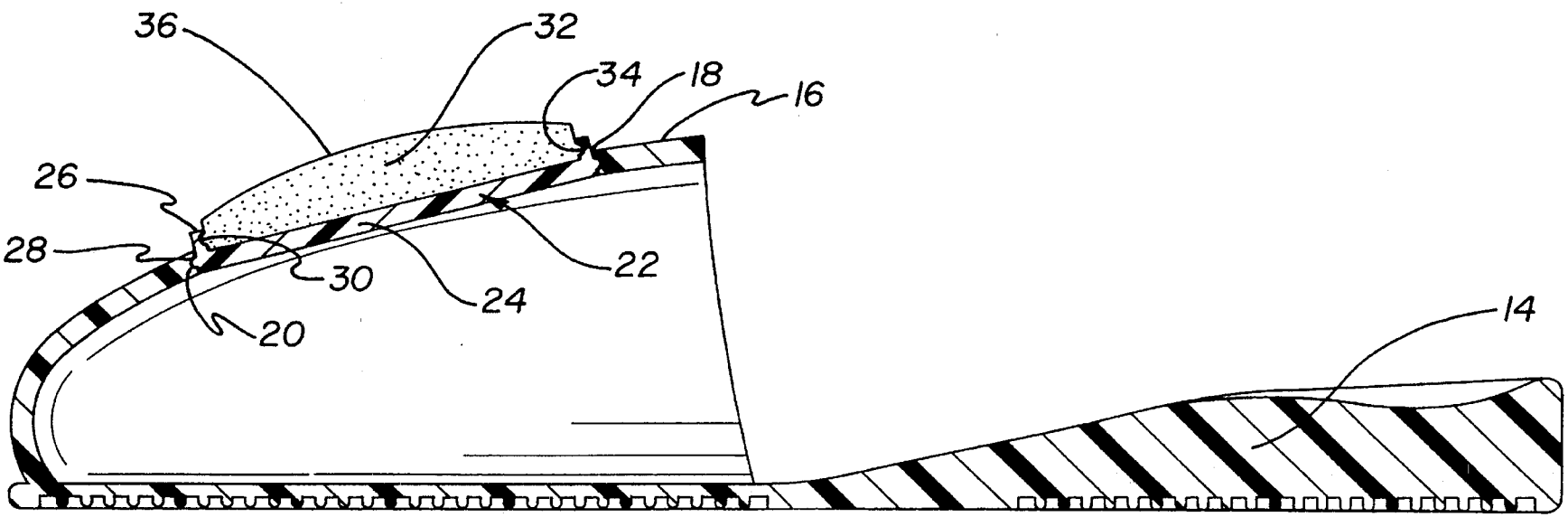
FIG. 4 is a cross sectional view of the invention as viewed along line 4—4 of FIG. 2.

More specifically, it will be noted that the shoe 10 includes a sole portion 12 which is symmetrically shaped along axial length. Preferably, the sole section 12 will be formed of a soft polymeric material, as indicated in FIG. 4, and would include a contoured and raised heel portion 14 integrally formed therewith. While a soft polymeric material may be utilized to form the sole portion 12, it is to understood that any type of material could be employed, to include the use of hard plastics. As such, the choice of material should not be construed as limiting the concept or functional aspects of the invention 10.

Integrally attached to the sole portion 12 is an outer covering section 16 which is also of a symmetrical design and shape along the axial length of the shoe 10 and which is envisioned as being engageable with a top of a wearer's foot so as to provide a conventional means of retaining the shoe in useable engagement with the wearer's foot. The outer cover 16 is provided with a through-extending aperture 18. The aperture 18 in the illustrated embodiment 10 is of an oval shape and includes a concentrically positioned oval groove 20 which extends around the entire periphery of the aperture.

An oval shaped retaining plate 22 is shaped to include a bottom plate member 24 having an upstanding wall portion 26 integrally formed therewith and extending around the entire periphery of the plate member. An integral outwardly extending ring 28 is formed around the entire periphery of the wall portion 26 and is configured to engage the groove 20 so as to selectively retain the retaining plate 22 in position within the aperture 18.

Figure 3:
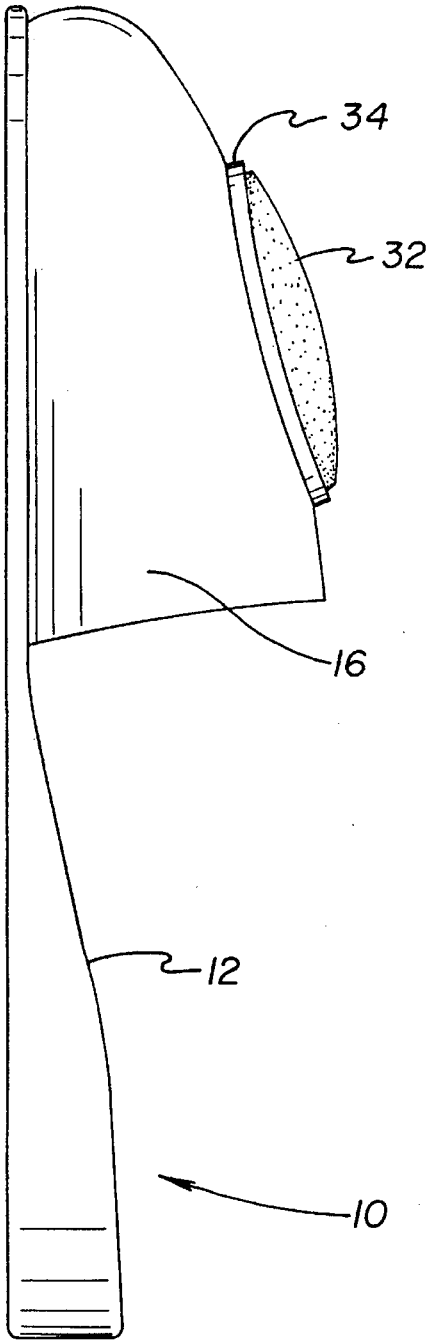
FIG. 3 is a side elevation view thereof.

The wall portion 26 is further provided with a circumferentially extending groove 30 around its entire interior surface and is integrally a part of the wall portion 26. An oval shaped pumice stone 32 is designed to be positionable against the plate member 24 and is shaped to conform to the wall portion 26 so as to be retained thereagainst. The pumice stone 32 includes a peripherally extending ring member 34 which is integrally a part thereof and which is engageable with the groove 30 formed in the wall portion 26 so as to be operable as a retaining means holding the pumice stone 32 in engagement with the retaining plate 22. The pumice stone 32 is further provided with an upwardly curved surface 36 which can be formed in a variety of different shapes to conform to the desires and needs of a user. Depending upon the positioning of callouses on a user's feet, the pumice stone 32 could be made available in a variety of different shapes to facilitate a proper use thereof, and the shape of the stone shown in FIGS. 3 and 4 is illustrative only of the many different shapes which could be provided.

As to a further discussion of the manner of usage and operation of the present invention, the same should be apparent from the above description. In this regard, it can be seen that the shoe 10 can be slipped on either foot of a wearer, and the wearer can then position the other remaining bare foot against the pumice stone 32 as best illustrated in FIG. 1. With little or no mental thought, as well as no manual requirements, the wearer can then move his or her foot back and forth across the pumice stone 32 to effect the abrasive removal of callouses in a now clearly understood manner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A therapeutic shoe comprising:

a sole;

solid cover means attached to said sole and being operable to overlie an upper surface of a wearer's foot, thereby to facilitate a retention of said sole on said wearer's foot, said solid cover means forming an enclosure over toes of said wearer's foot; and abrasion means attached to said shoe and being utilizable to selectively provide abrasive treatment to said wearer's skin, said abrasion means being attached to said cover means forming a part of said therapeutic shoe, said abrasion means being retained within an opening formed in said cover means, said abrasion means including a retaining plate secured within said opening so as to effect a retention of said abrasion means therewith, wherein said abrasion means including a pumice stone, said pumice stone is secured within said opening by said retaining plate, said retaining plate being provided with an upstanding wall having an interior circumferential groove, said interior groove being engageable with a circumferentially extending ring member formed on said pumice stone, thereby to effect a retention of said pumice stone within said abrasion means.

2. As described in claim 1, wherein said retaining plate further includes an exterior circumferential ring member engageable with a further groove formed in said opening, thereby to retain said abrasion means within said opening formed in said cover means.

3. As described in claim 2, wherein said pumice stone is provided with an arcuate upper surface.

* * * * *